US007360885B2

(12) United States Patent
Hirai

(10) Patent No.: US 7,360,885 B2
(45) Date of Patent: Apr. 22, 2008

(54) INK-JET PRINTER AND INK-JET IMAGE FORMING METHOD USING THE SAME

(75) Inventor: Yoko Hirai, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 210 days.

(21) Appl. No.: 10/683,502

(22) Filed: Oct. 10, 2003

(65) Prior Publication Data

US 2004/0075726 A1 Apr. 22, 2004

(30) Foreign Application Priority Data

Oct. 18, 2002 (JP) ..... 2002-304261

(51) Int. Cl.
*B41J 2/01* (2006.01)

(52) U.S. Cl. ..... 347/102; 347/101

(58) Field of Classification Search ..... 347/101–103
See application file for complete search history.

(56) References Cited

U.S. PATENT DOCUMENTS

| | | | | |
|---|---|---|---|---|
| 5,105,204 | A * | 4/1992 | Hoisington et al. | 347/105 |
| 5,721,020 | A * | 2/1998 | Takami et al. | 427/508 |
| 6,000,793 | A * | 12/1999 | Inamoto | 347/101 |
| 6,561,640 | B1 * | 5/2003 | Young | 347/102 |
| 2002/0075371 | A1 * | 6/2002 | Beehler et al. | 347/101 |
| 2004/0036753 | A1 * | 2/2004 | Hirai | 347/102 |
| 2004/0041893 | A1 * | 3/2004 | Hoshino | 347/102 |

* cited by examiner

*Primary Examiner*—Manish S. Shah
(74) *Attorney, Agent, or Firm*—Lucas & Mercanti, LLP

(57) ABSTRACT

An ink-jet printer for applying a photocurable ink, including: an ink-jet head having a plurality of nozzles to jet droplets of the photocurable ink onto a recording material; a ultraviolet ray radiation source; and a heating device for the recording material, wherein the radiation source produces an integrated illuminance of 0.5 to 80 mW/cm$^2$ on the recording material in the range of 200 to 400 nm.

4 Claims, 1 Drawing Sheet

INK-JET PRINTER AND INK-JET IMAGE FORMING METHOD USING THE SAME

TECHNICAL FIELD

The present invention relates to an ink-jet printer and an ink-jet image forming method using the same, and in more detail, to an ink-jet printer having a means to heat the ultraviolet curing type ink deposited onto a recording medium and an ultraviolet radiation means which enhances scratch resistance and bending resistance characteristics of images after printing, and an ink-jet image forming method using the same.

BACKGROUND

Recently, because of the fact that ink-jet recording methods produce images simply and at low cost, they have been applied to various printing fields such as photography, various kinds of printing, and special printing jobs such as marking and production of color filter. Specifically, for the recording apparatus by which fine dots are ejected and controlled, ink whose color reproduction area, durability, and ejecting property are improved, and an exclusive use sheet in which the absorbability of the ink, coloring property of the coloring material, surface glossiness are greatly increased, are used, and the image quality comparative to silver halide photography can be obtained. The increase of the image quality of today's ink-jet recording system is achieved only when a state of the art recording apparatus, ink, and exclusive use sheet are present.

However, in the ink-jet system for which an exclusive use sheet is necessary, the recording medium is limited and the increased cost of the recording medium becomes a factor. Accordingly, many trials to record onto the transferred medium other than exclusive use sheets by the ink-jet system have been made. Specifically, a phase change ink-jet system in which a solid wax ink, being solid at room temperature, is used, a solvent series ink-jet system in which the ink in which a quick dry type organic solvent is a main component, is used, or an ultraviolet ink-jet system in which, after the recording, a cross-linkage is formed by exposure to ultra violet (UV) rays.

Among the above-mentioned experiments, the UV ink-jet system has a relatively low odious smell comparing to the solvent series ink-jet system, and for its strong point in that it can record onto recording media not featuring a quick dry property and ink absorbability, it has been noted recently. Listed as examples are, for example, JP-B (hereinafter, the term JP-B referrers to an examined Japanese Patent Publication) 5-54667, JP-A (hereinafter, the term JP-A refers to a Japanese Patent Application Publication) 6-200204, and Japanese Translated PCT Patent Publication No. 2000-504778, in which an ultraviolet curing type ink-jet ink is disclosed.

As mentioned above, the ink-jet image forming method using ultraviolet curing ink, being different from the existing ink-jet system using water-based ink, is expected to be practically applied to non-absorptive media such as plastic film, since better images can be obtained even without an ink absorbing layer in the recording medium. The ultraviolet curing type ink is prepared with radical polymerization or cationic polymerization. Cationic polymerization type ink is not affected by polymerization inhibition by oxygen, resulting in a quite advantageous technology to achieve high sensitivity in an image forming method using ink-jet ink droplets having a large specific surface area. However, it also has drawbacks such as having a tendency to be affected by the atmosphere at the time of image recording, such as ambient temperature and humidity.

To overcome the foregoing drawbacks, proposed has been a method to enhance acceleration of the ink hardening rate by provision of a deposited ink heating means (for example, ref. Patent Document 1). However, in cases when the foregoing method is applied to methods which supply a large amount of ink at once onto the recording medium, such as a so-called serial printer with reduced interleaves, or a printer using a line head, the balance of hardening between the recording medium surface and the rear surface is lost when cured by ultraviolet rays, specifically in high humidity conditions, resulting in lowered scratch resistance of formed images, or problems of causing cracks on the image surface when bent. Therefore, the present situation is urgent development of an improved solution is desired.

Patent Document 1: JP-A 2002-137375 (claims)

SUMMARY

In view of the above-described drawbacks, the present invention was attained, and an object of the present invention is to provide an ink-jet printer having a means to heat the ultraviolet curing type ink deposited onto a recording medium and an ultraviolet radiation means which enhances scratch resistance and bending resistance characteristics of images after printing, and an ink-jet image forming method using the same.

The above-described objects of the present invention are attained by the following structures.

1. An ink-jet printer for applying a photocurable ink, comprising:
   an ink-jet head having a plurality of nozzles to jet droplets of the photocurable ink onto a recording material;
   a ultraviolet ray radiation source; and
   a heating device for the recording material,
   wherein the radiation source produces an integrated illuminance of 0.5 to 80 mW/cm$^2$ on the recording material in the range of 200 to 400 nm
2. The ink-jet printer of item 1, wherein an irradiation time by the ultraviolet ray radiation source is not more than 1.0 second.
3. The ink-jet printer of item 1, wherein the photocurable ink contains a photopolymerizable cationic monomer.
4. The ink-jet printer of item 1 or item 2, wherein the recording material is non ink absorptive.
5. The ink-jet printer of item 1 or item 2, wherein the recording material is heated at 35 to 55° C. after jetted the droplets of the photocurable ink.

DESCRIPTION OF THE PREFERRED EMBODIMENTS

Figure 1:
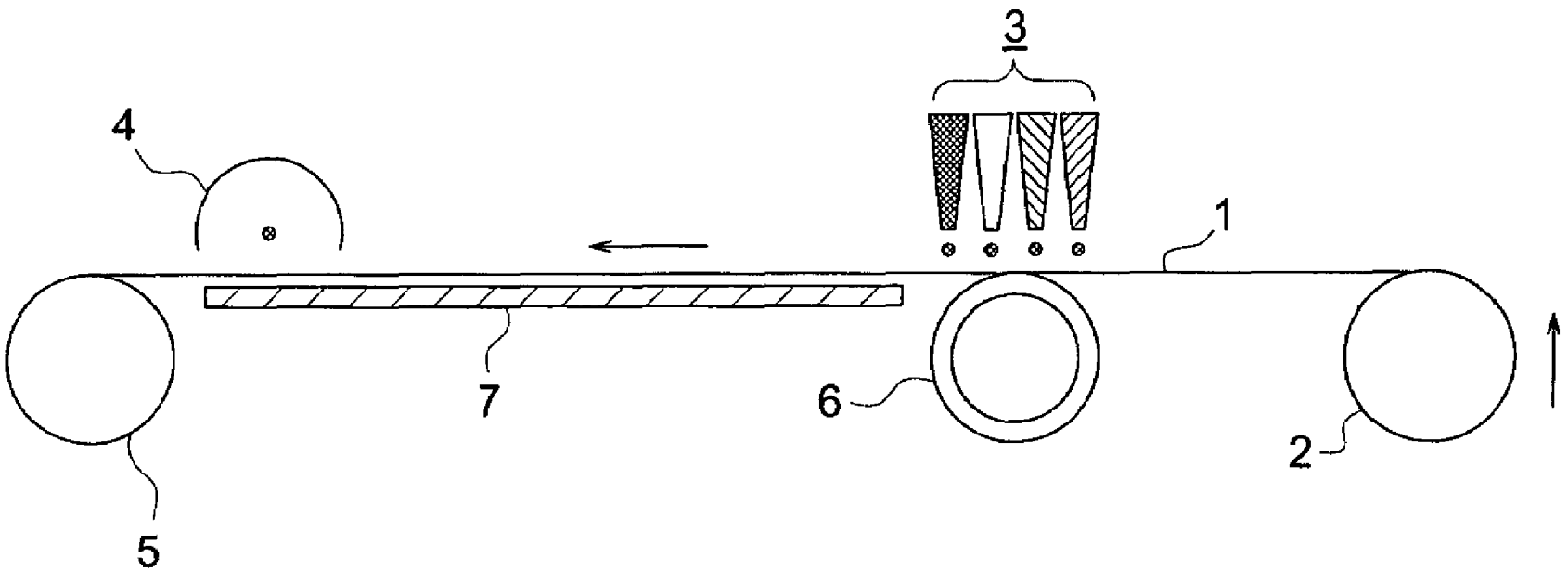
FIG. 1 is a schematic diagram of an ink-jet printer which can be used in the present invention.

The details of the present invention will be described below.

In the present invention, an ink-jet printer which enables printing with ejection of a photo-cationic polymerization type ultraviolet curing ink onto a recording medium through an ink-jet head having a plurality of nozzles, is characterized by having a means to heat the ultraviolet curing type ink deposited onto a recording medium incorporating an ultraviolet radiation means, and by integrated illuminance of that ultraviolet radiation means in wave lengths of 200-400 nm on a recording medium surface, being 0.5-80 mW/cm$^2$.

<<Photopolymerizable Compounds>>

Photopolymerizable compounds used in the present invention, especially photopolymerizable cationic monomers, will now be described.

Employed as photopolymerizable cationic monomers may be various types of cationic polymerizable monomers known in the art. Listed, for example, are epoxy compounds, vinyl ether compounds, and oxetane compounds exemplified in Japanese Patent Application Open to Public Inspection Nos. 6-9714, 2001-31892, 2001-40068, 2001-55507, 2001-310938, 2001-310937, and 2001-220526.

In order to reduce the volume shrinkage of the recording material after hardening of the ink, the ink of the present invention preferably incorporates at least one oxetane compound which photo-polymerizes and at least another one compound selected from epoxy compounds and vinyl ether compound.

(Epoxy compound)

Among epoxy compounds, referable aromatic epoxy compounds are di- or poly-glycidyl ether, which is synthesized by the reaction of polyhydric phenol having at least one aromatic core or alkylene oxide-added polyhydric phenol and epichlorohydrin, and for example, di- or poly-glycidyl ether of bisphenol A or of alkylene oxide-added bisphenol A, di- or poly-glycidyl ether of hydrogenated bisphenol A or of alkylene oxide-added hydrogenated bisphenol A, and novolak type epoxy resin, are listed. Herein, as alkylene oxide, ethylene oxide and propylene oxide are listed.

As alicyclic epoxide, a cyclohexene oxide or cyclopentene oxide, which is obtained by epoxidation of the compound having cycloalkane ring such as at least one cyclohexene or cyclopentene ring by the appropriate oxidant such as hydrogen peroxide or peracid, is preferable.

As a preferable aliphatic epoxide, there is di- or poly-glycidyl ether of aliphatic polyvalent alcohol or of alkylene oxide-added aliphatic polyvalent alcohol, and as its representative example, di-glycidyl ether of alkylene glycol such as di-glycidyl ether of ethylene glycol, di-glycidyl ether of propylene glycol and glycidyl ether of 1,6-hexane diol, poly-glycidyl ether of polyvalent alcohol such as di- or tri-glycidyl ether of glycerin or of alkylene oxide added glycerin, and di-glycidyl ether of polyalkylene glycol such as di-glycidyl ether of polyethylene glycol or of alkylene oxide-added polyethylene glycol, and di-glycidyl ether of polypropylene glycol or of alkylene oxide-added polypropylene glycol, are listed. Herein, as alkylene oxide, ethylene oxide and propylene oxide are listed.

In these epoxides, when the quick hardening ability is considered, aromatic epoxide and alicyclic epoxide are preferable, and particularly, alicyclic epoxide is preferable. In the present invention, on kind of the above epoxides may be solely used, and more than 2 kinds of them may also be used by appropriately being combined.

(Vinyl Ether Compound)

Also as a vinyl ether compound preferably used in the ink of the present invention, publicly known vinyl ether compounds can be used, and for example, di or tri-vinyl ether compound, such as ethylene glycol di-vinyl ether, di-ethylene glycol di-vinyl ether, tri-ethylene glycol di-vinyl ether, propylene glycol di-vinyl ether, di-propylene glycol di-vinyl ether, butane diol di-vinyl ether, hexane diol di-vinyl ether, cyclohexane di-methanol di-vinyl ether, tri-methylol propane tri-vinyl ether, or mono vinyl ether compound, such as ethyl vinyl ether, n-butyl vinyl ether, iso-butyl vinyl ether, octadecyl vinyl ether, cyclohexyl vinyl ether, hydroxy butyl vinyl ether, 2-ethyl-hexyl vinyl ether, cyclo-hexane di-methanol mono-vinyl ether, n-propyl vinyl ether, iso-propyl vinyl ether, iso-propenyl ether-o-propylene carbonate, dodecyl vinyl ether, or di-ethylene glycol mono vinyl ether vinyl ether, is listed.

In these vinyl ether compounds, when the hardenability, adhesion or surface hardness is considered, di or tri-vinyl ether compound is preferable, and particularly di-vinyl ether compound is preferable. In the present invention, one kind of the above vinyl ether compounds may also be used, and more than two kinds of them may also be used by being appropriately combined.

An oxetane compound of the present invention is a compound having an oxetane ring in the molecule. The known oxetane compounds described in JP-A 2001-220526 and JP-A 2001-310937 can be used.

When an oxetane compound having 5 or more oxetane rings in the molecule is used in a ink composition, the viscosity of the ink composition tends to become high. As a result, it is hard to handle the ink composition. At the same time, the glass transition temperature becomes too high to obtain sufficient adhesion property after hardening.

The oxetane compound of the present invention has preferably 1 to 4 oxetane rings in the molecule.

Examples of the oxetane compounds used in the present invention are described, but the present invention is not restricted to the following compounds.

As oxetane compounds having one oxetane ring are shown by the following General Formula (1).

General Formula (1)

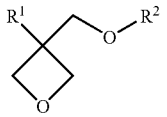

In the General Formula (1), $R^1$ is a hydrogen atom, alkyl group having 1-6 carbon atoms such methyl group, ethyl group, propyl group or butyl group, fluoro-alkyl group having 1 to 6 carbon atoms, allyl group, aryl group, furyl group, or thienyl group. $R^2$ is an alkyl group having 1 to 6 carbon atoms such as methyl group, ethyl group, propyl group or butyl group; alkenyl group having 2 to 6 carbon atoms such as 1-propenyl group, 2-propenyl group, 2-methyl-1-propenyl group, 2-methyl-2-propenyl group, 1-butenyl group, 2-butenyl group or 3-butenyl group; a group having aromatic ring such as phenyl group, benzyl group, fluoro-benzyl group, methoxybenzyl group or phenoxyethyl group; alkyl carbonyl group having 2 to 6 carbon atoms such as ethyl carbonyl group, propyl carbonyl group or butyl carbonyl group; alkoxy carbonyl group having 2 to 6 carbon atoms such as ethoxy carbonyl group, propoxy carbonyl group or butoxy carbonyl group; N-alkyl carbamoyl group having 2 to 6 carbon atoms such as ethyl carbamoyl group, propyl carbamoyl group, butyl carbamoyl group or pentyl carbamoyl group. As the oxetane compound used in the present invention, it is particularly preferable that the compound having one oxetane ring is used, because the obtained composition is excellent in the coking property, and the operability is excellent in the low viscosity.

Next, as the compound having two oxetane rings, the compounds shown by the following General Formula (2) are listed.

General Formula (2)

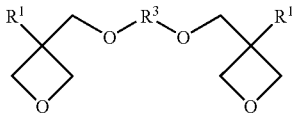

In the General Formula (2), $R^1$ is the same group as the group shown in the above-described General Formula (1). $R^3$ is, for example, a linear or branching alkylene group such as ethylene group, propylene group or butylene group; linear or branching poly (alkylene-oxy) group such as poly (ethylene oxy) group or poly (propylene oxy) group; linear or branching un-saturated hydrocarbon group such as propenylene group, methyl propenylene group or butenylene group; carbonyl group; alkylene group including carbonyl group; alkylene group including carboxyl group; alkylene group including carbamoyl group.

Further, $R^3$ may also be a polyhydric group selected from the group shown by the following General Formulas (3), (4) and (5).

General Formula (3)

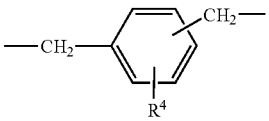

In the General Formula (3), $R^4$ is a hydrogen atom, an alkyl group having 1 to 4 carbon atoms such as methyl group, ethyl group, propyl group or butyl group, or alkoxy group having 1 to 4 carbon atoms such as methoxy group, ethoxy group, propoxy group or butoxy group, or halogen atom such as chloride atom or bromine atom, nitro group, cyano group, mercapto group, lower alkyl carboxyl group such as the group having 1 to 5 carbon atoms, carboxyl group, or carbamoyl group.

General Formula (4)

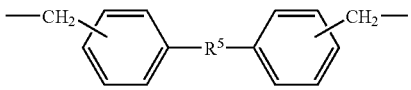

In the General Formula (4), $R^5$ is oxygen atom, sulfide atom, methylene group, —NH—, —SO—, —$SO_2$—, —$C(CF_3)_2$—, or —C $(CH_3)_2$—.

General Formula (5)

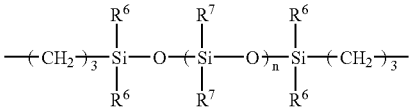

In the General Formula (5), $R^6$ is an alkyl group having 1 to 4 carbon atoms such as methyl group, ethyl group, propyl group or butyl group, or aryl group. Numeral n is an integer of 0-2000. $R^7$ is an alkyl group having 1 to 4 carbon atoms such as methyl group, ethyl group, propyl group or butyl group, or aryl group. $R^7$ is also a group selected from the group shown by the following General Formula (6).

General Formula (6)

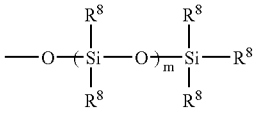

In the General Formula (6), $R^8$ is an alkyl group having 1 to 4 carbon atoms such as methyl group, ethyl group, propyl group or butyl group, or aryl group. Numeral m is an integer of 0-100.

As a specific example of the compound having 2 oxetane rings, the compounds shown by the following structural formulas are listed.

Exemplified compound 1

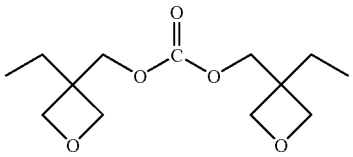

Exemplified compound 2

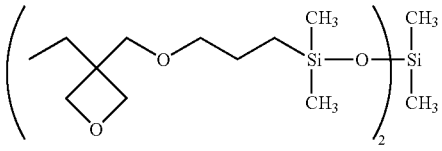

Exemplified compound 14 shown by the above structural formula is a compound in which $R^1$ is an ethyl group, and $R^3$ is a carboxy group in General Formula (2).

Exemplified compound 15 shown by the above structural formula is a compound in which each $R^6$ and $R^7$ are a methyl group, and n is 1 General Formula (5).

Among the compound having 2 oxetane rings, as a preferable example except for the above-described compounds, there are compounds shown by the following General Formula (7). In the General Formula (7), $R^1$ is the same group as in the General Formula (1).

General Formula (7)

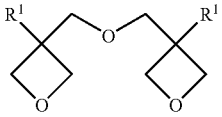

As the compounds having 3-4 oxetane rings, the compounds shown in the following General Formula (8) are listed.

General Formula (8)

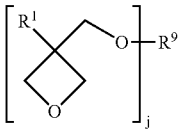

In the General Formula (8), $R^1$ is the same group as in the General formula (1). $R^9$ is, for example, branching alkylene group having 1 to 12 carbon atoms such as groups shown by the following General Formulas (9), (10), branching poly (alkylene oxy) group such as group shown by the following General Formula (11), or branching polysiloxane group such as group shown by the following General Formula (12) is listed. Numeral j is 3 or 4.

A

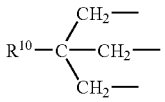

B

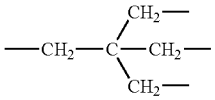

C

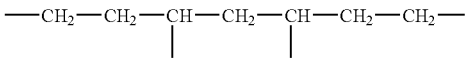

D

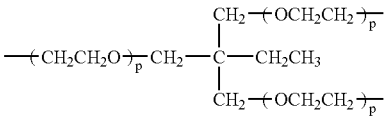

E

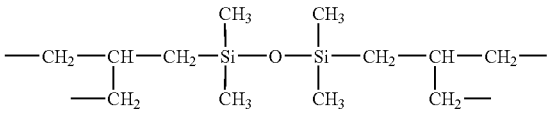

In Formula A, $R^{10}$ is a lower alkyl group such as a methyl, ethyl, or propyl group. In Formula D, p is an integer of 1 to 10.

As the specific example of the compound having 3 to 4 oxetane rings, the compound shown in the following Exemplified 3 is cited.

Exemplified compound 3

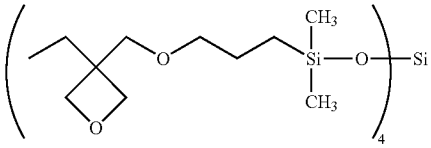

Furthermore, as an example of the compounds having 1-4 oxetane rings except the above examples, there are compounds shown in the following General Formula (9).

General Formula (9)

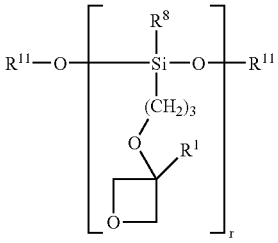

In the General Formula (9), R1 is the same group as in General Formula (1) and $R^8$ is the same group as in the General Formula (6). $R^{11}$ is alkyl group having 1 to 4 carbon atoms such as methyl group, ethyl group, propyl group or butyl group, or tri-alkyl silyl group, and numeral r is 1-4.

As preferable specific examples of the oxetane compounds used in the present invention, there are compounds shown below.

Exemplified compound 4

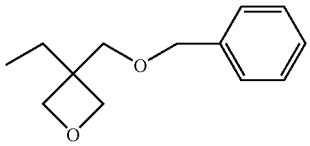

Exemplified compound 5

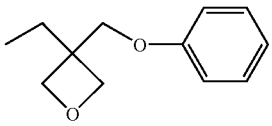

Exemplified compound 6

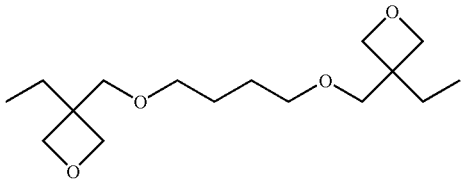

The production method of the compounds having the oxetane ring is not particularly limited, and it may be conducted according to the conventionally known method, and for example, there is a synthetic method of an oxetane ring from diol disclosed by Pattison (D. B. Pattison, J. Am. Chem. Soc., 3455, 79 (1957)).

Further, other than them, compounds having 1-4 oxetane rings, which have high molecular weight of molecular weight of about 1000-5000, are also listed. As an example of them, for example, the following compounds are listed.

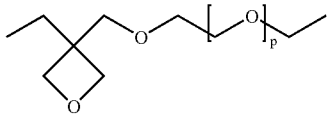

p: 20~200

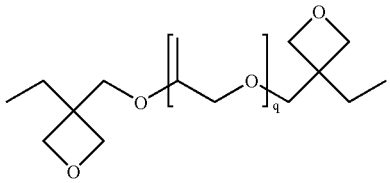

q: 15~100

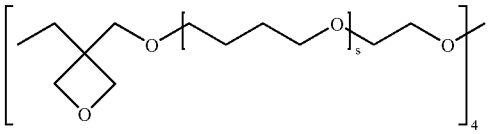

s: 20~200

As the photo initiator, all publicly known photo acid generators (a compound which generates the acid by the active ray, such as ultraviolet rays) can be used. As the photo acid generator, for example, a chemical amplification type photo resist or compound used for the light cationic polymerization is used (Organic electronics material seminar "Organic material for imaging" from Bunshin publishing house (1993), refer to page 187-192). Examples preferable for the present invention will be listed below.

Firstly, aromatic onium compound $B(C_6F_5)_4^-$, $PF_6^-$, $AsF_6^-$, $SbF_6^-$, $CF_3SO_3^-$ salt, such as diazonium, ammonium, iodonium, sulfonium, phosphonium, can be listed.

Specific examples of the onium compounds will be shown below.

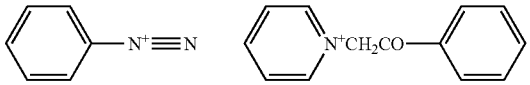

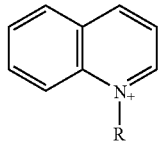

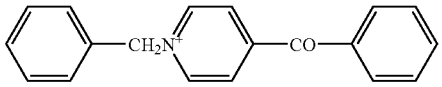

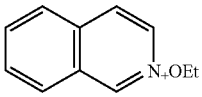

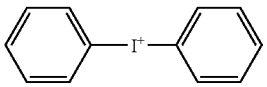

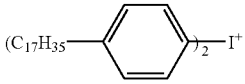

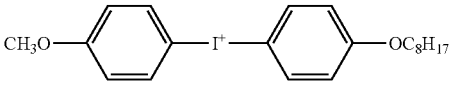

-continued

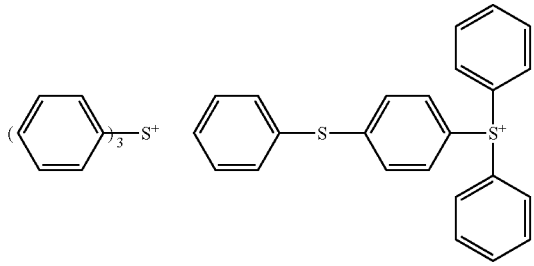

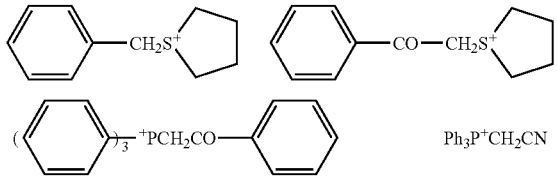

Secondly, sulfone compounds, which generate sulfonic acid, can be listed. Examples of specific compounds will be shown below.

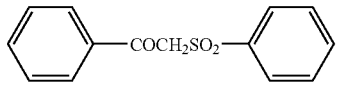

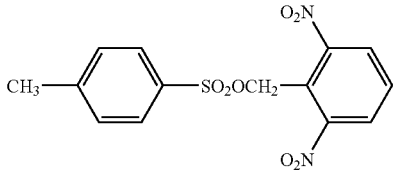

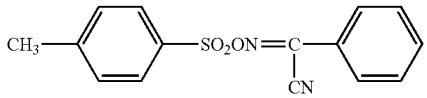

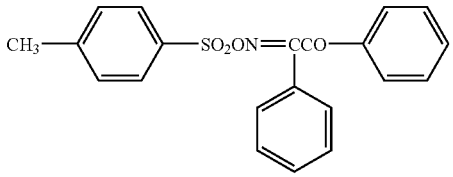

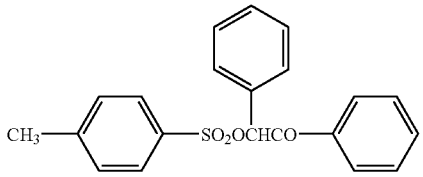

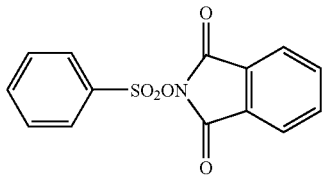

-continued

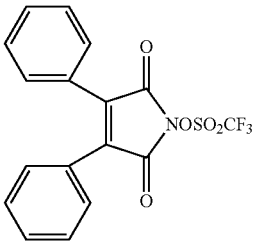

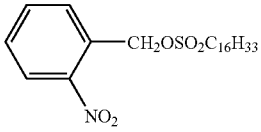

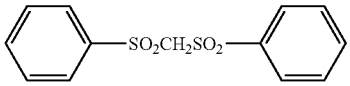

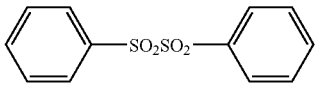

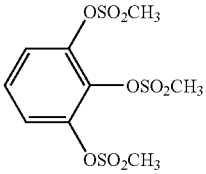

Thirdly, halogenide which generates hydrogen halide can also be used. Examples of specific compounds will be shown below.

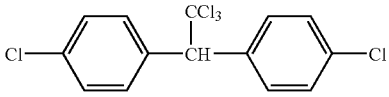

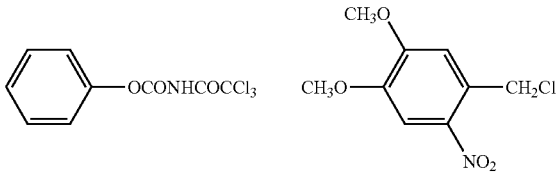

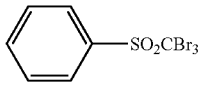

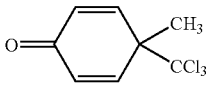

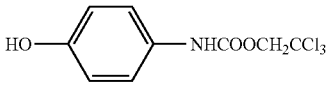

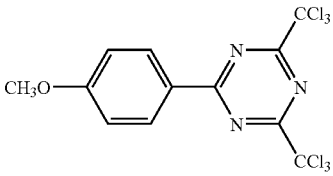

Fourthly, ferrite allene complex can be listed.

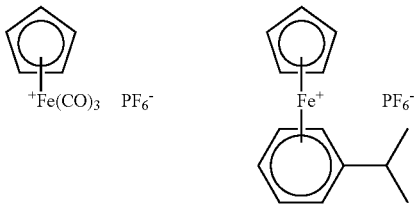

An ultraviolet curing type ink of this invention preferably contains an acid enhancing agent which generates acids by radiation of ultraviolet rays, which is readily known in the art as described in JP-A Nos. 8-248561 and 9-34106. Using an acid enhancing agent enables enhancement of more stable ejection.

In an ultraviolet curing type ink of this invention, it is preferable to contain a thermo-base generation agent to enhance ejection stability. By containing a thermo-base generation agent, it is possible, in ink-jet recording in which printed ink thickness tends to be greater compared to usual printing, to significantly reduce curling and creasing of the recording medium caused by ink shrinkage during ink hardening.

Heretofore, in the field of flexible packaging printing and label printing, ultraviolet curing type ink-jet recording has not reached practical use from the viewpoint of creasing of recording medium and ejection stability. However, it exhibits sufficient desired effects in those fields when it features the constitution of this invention.

As thermo-base generation agents, preferably used are, for example, organic acids and basic salts which are decarboxylated in decomposition by heating, compounds which decompose to release amines by reactions such as intermolecular nucreophilic substitution, Lossen rearrangement or Beckmann rearrangement, and compounds causing some sort of reaction to release a base by heating. Specifically listed are salts of trichloroacetic acid described in British Patent 998,949, salts of alpha-sulfonylacetic acid described in U.S. Pat. No. 4,060,420, salts of propyl acids and derivatives of 2-carboxycarboxamide described in JP-A 59-157637, salts of thermal decomposition acids using alkaline metals and alkaline-earth metals other than organic bases as basic components described in JP-A 59-168440, hydroxamcarbamates using Lossen rearrangement described in JP-A 59-180537, and aldoxymecarbamates generating nitriles by heating described in JP-A 59-195237. In addition to these, useful are thermo base generation agents described in British Patent 998,945, U.S. Pat. No. 3,220,846, British Patent 279,480, JP-A Nos. 50-22625, 61-32844, 61-51139, 61-52638, 61-51140, 61-53634-61-53640, 61-55644, and 61-55645. Further, specifically listed are guanidine trichloroacetate, methylguanidine trichloroacetate, potassium trichloroacetate, guanidine p-methanesulfonylphenylsulfonylacetate, guanidine p-chlorophenylsulfonylacetate, guanidine p-methanesulfonylphenylsulfonylacetate, potassium phenylpropyolate, guanidine phenylpropyolate, cesium phenylpropyolate, guanidine p-chlorophenylpropyolate, guanidine p-phenylene-bis-phenylpropylate, tetramethyl ammonium phenylsulfonylacetate, and tetramethyl ammonium phenylpropyolate. The foregoing thermo-base generation agents may be employed in the wide range.

The colorants used in the present invention are those which can be solved or dispersed in a main component of the polymeric compound. However, from the viewpoint of weather fastness, the pigment is preferable.

As the pigment, the followings can be used, however, it is not limited to these.

C.I. Pigment Yellow-1, 3, 12, 13, 14, 17, 81, 83, 87, 95, 109, 42,

C. I. Pigment Orange-16, 36, 38,

C. I. Pigment Red-5, 22, 38, 48:1, 48:2, 48:4, 49:1, 53:1, 57:1, 63:1, 144, 146, 185, 101, C. I. Pigment Violet-19, 23, C. I. Pigment Blue-15:1, 15:3, 15:4, 18, 60, 27, 29, C. I. Pigment Green-7, 36

C. I. Pigment White-6, 18, 21,

C. I. Pigment Black-7.

Further, in the present invention, in order to enhance covering power of color on transparent substrates such as plastic film, it is preferable to use a white ink. Specifically, in soft package printing and label printing, it is preferable to use a white ink. However, from the viewpoint of the aforesaid ejection stability, and the formation of curling and wrinkling, the amount to be used is obviously limited.

To disperse the pigment, a ball mill, sand mill, attritor, roll mill, agitator, Henschel mixer, colloid mill, ultrasonic homogenizer, Pearl mill, wet jet mill, or paint shaker may be used. Further, when the pigment is dispersed, the dispersing agent can also be added. It is preferable that, as the dispersing agent, high polymeric dispersing agent is used. As the high polymeric dispersing agent, Solsperse series of Avecia co., is cited.

Further, as the dispersion auxiliary agent, the synergist corresponding to each kind of pigment can also be used. It is preferable that 1-50 parts by weight of these dispersing agent and dispersion auxiliary agent are added to 100 parts by weight of the pigment. The dispersion medium is solvent or polymeric compound, and it is preferable that the ultraviolet ray-curable ink used in the present invention comprises no-solvent, because it is reacted and hardened just after the arrival of the ink. When the solvent remains in the hardened image, the problem of deterioration of solvent resistance and VOC (Volatile Organic Compound) of the remained solvent is raised. Accordingly, it is preferable in the dispersion aptitude that the dispersion medium is not solvent, but polymeric compounds, and the monomer in which the viscosity is lowest in them, is selected.

When the dispersion is conducted, it is preferable to configure the pigment, dispersing agent, selection of diluent for the dispersion so that average particle size of the pigment become 0.08-0.5 μm, more preferably 0.3-10 μm, still more preferably, 0.3-3 μm. By this particle size control, the nozzle plugging of the ink-jet head is suppressed, and the preservation stability of the ink, ink transparency and hardening sensitivity can be maintained.

It is preferable for the colorant that the addition amount is 1 weight % to 10 weight % of the whole of the ink.

A various additives can be used in the ink beside the above-described materials. Examples of the additives are: surfactants, leveling additive agents, mat agents, polyester resins for adjusting the film property, polyurethane resins, vinyl resins, acrylic resins, rubber resins, or wax. In order to improve the adhesion to the recording medium, it is also effective that the very fine amount of organic solvent is added. In this case, the addition within the range that the problem of the solvent resistance or VOC is not generated, is effective, and the amount is 0.1-5 weight %, preferably 0.1-3 weight % of the total ink weight.

Subsequently, an ink-jet printer and an ink-jet image forming method will be described.

An ink-jet printer of the present invention, after the foregoing ultraviolet curing type ink is ejected onto a recording medium through an ink-jet head having a plurality of nozzles, is characterized by having a means to heat the ultraviolet curing type ink deposited onto a recording medium and an ultraviolet radiation means, and by integrated illuminance of that ultraviolet radiation means in wave lengths of 200-400 nm on the recording medium surface, being 0.5-80 mW/cm$^2$.

As mentioned above, an ink-jet image forming method of this invention is that ultraviolet rays are radiated to harden the ink after an ultraviolet curing type ink is ejected onto a recording medium through an ink-jet head to form images and is heated to 35-55° C. by a heating means.

An ink-jet image forming method of this invention exhibits significant effects specifically when a line-head printer is employed. In the case of a serial printer, ink ejection with one time scanning using an interleave method can be optionally controlled. However, in the case of a line-head printer, high speed printing becomes feasible, and on the other hand, when printing solid images, ink necessary to cover the recording medium has to be ejected in one scanning process, so that controlling of optimum physical characteristics of the image layer only with an ejecting method is quite difficult. But by using an ink-jet image forming method provided with a heating means of this invention, excellent physical image characteristics are obtained, and especially, enhancement of scratch resistance and bending resistance characteristics when printed under high humidity conditions are expected.

FIG. 1 is a schematic drawing which represents an example of configurations of an ink-jet printer appropriate in this invention.

In FIG. 1, Recording Medium 1 wound on Supply Roller 2 is pulled out to the desired position, and ultraviolet curing type ink colors of cyan, magenta, yellow and black are ejected onto Recording Medium 1 from Ink-jet Head 3. The ultraviolet curing type ink deposited onto Recording Medium 1 is light radiated with Ultraviolet Ray Radiation Device 4, after heated to 35-55° C. by Heating Means 7 comprised of such as a heating plate, and then, the ultraviolet curing type ink is fixed onto Recording Medium 1, after which Recording Medium 1 is wound onto Take-up Roll 5. Further, "6" represents a back-up roller for better positioning.

As ink ejection conditions, it is preferable from the viewpoint of ejection stability that the ink is heated 40-80° C. whereby ink viscosity is lowered at ejection. A radiation ray curing type ink exhibits generally higher viscosity than water based ink, resulting in greater viscosity fluctuation by temperature changes. Because viscosity fluctuation directly affects ink droplet size and ejection rate of ink droplets, which causes image deterioration, it is desired to maintain a constant ink temperature as much as possible.

As the ink-jet head used for the ink-jet printer in this invention (hereinafter, referred to simply as head), commonly known heads may be employed, and consequently, it is possible to use a continuous type and a dot on-demand type head. Of these dot on-demand type heads, a type of thermal heads having an operating valve for ejection as described in JP-A 9-323420 is preferable. In piezo heads, those described in European Patents A277,703 and A278,590 may also be employed. To control ink temperature, it is preferable that the heads have a temperature control function. Also preferred is a means to adjust the ejection temperature to maintain a viscosity of 5-25 mPa·s at ejection, and to control ink temperature so that the viscosity fluctuation range is within ±5%. Further, the driving frequency preferably is 5-500 kHz.

In this invention, it is preferable that the ink droplet amount is 2-20 pl to maintain high-definition images. The ink of this invention exhibits excellent ejection characteristics, resulting in high quality images without nozzle clogging, target error of dots and satellites (ink splash).

Further, in this invention, the total printed ink thickness is preferably 2-20 μm to obtain glossy high class images.

A heating means of this invention may be placed on the rear surface of a recording medium, or on the front surface of the image printed recording medium. Examples of heating means include, for example, a halogen lamp heater, a ceramic heater, a heat roller with a built-in heating element, a heating plate using a metal plate or a heat-resistant silicon lubber, a hot stamping method, a thermal head, a far-infrared ray heating device, a microwave heating method to heat a substance by radiation with high frequency waves, and a dielectric heating method, and in addition to these, any other heating method known in the art may be employed.

The heating means of this invention is required to maintain a specific temperature (being in the range of 35-55° C.) in a heating section, and so, it is preferable to maintain the temperature of a recording medium at a constant level, providing a temperature detecting means for the recording medium and a temperature control means to adjust it to the specific temperature based on feedback of the detected temperature, and further providing a cooling means if necessary. The temperature of the recording medium is preferably heated to 35-55° C., and at a lower temperature than in this range, the desired effects cannot be obtained, and at a higher temperature than in this range, problems such as deteriorated layer transparency results.

In the ink-jet image forming method of this invention, an ultraviolet ray radiation means is provided to harden and fix the printed ultraviolet curing type ink, after the recording medium has been heated by the foregoing heating means.

In the ink-jet image forming method of this invention, it is possible to harden images after images are formed onto the recording medium, using various radiation sources such as ultraviolet rays, electron radiation, X-rays, visible light, infrared rays, but when considering hardenability and the cost of radiation sources, ultraviolet rays are preferable. As ultraviolet sources, applicable are a mercury lamp, a metal halide lamp, an excimer laser, an ultraviolet laser, a cold cathode-ray tube, a black light lamp, and an LED (light emitting diode). Of these, preferred are a belt-like metal halide lamp, a cold cathode-ray tube, a mercury lamp tube and a black light lamp. Specifically, a cold cathode-ray tube and a black light lamp which radiate ultraviolet rays at a wavelength of 365 nm are preferable, because they effectively prevent bleeding and control dot diameter, and further reduce creasing during hardening. A radiation means to harden UV ink can be prepared at low cost by using black light as a radiation source for a radiation means.

A basic radiation method is described in JP-A 60-132767. Based on this description, light sources are provided on both sides of a head unit, and the head and the light sources are scanned in a shuttling method. Radiation is performed for predetermined intervals after ink deposition. Further, hardening is completed by another light source using no additional driving energy. In WO 9,954,415, as radiation methods, disclosed are a method using optical fibers, and a method radiating ultraviolet rays onto a recording area in which collimated light sources are targeted to mirror surfaces prepared on the sides of the head unit. In the ink-jet image forming method of this invention, any of the foregoing radiation methods may be employed.

As specific examples, a belt-like metal halide lamp tube and an ultraviolet lamp tube are preferable. It is possible to obtain an inexpencive configuration by securely fixing a radiation source to the recording apparatus, eliminating moving parts.

Radiation is preferably performed for every separate color printing, in other words, one of the preferable forms is to provide two kinds of radiation sources and to complete hardening employing the second radiation source in any radiation method. This contributes to wettability of the following deposited ink, obtaining better adhesion between inks, and assembly of the radiation sources at moderate cost.

Further, it is preferable that the first radiation source and the second radiation source be different in radiation wavelength and radiation illumination. The initial radiation energy level is preferably less than the following radiation energy level, that is, the first radiation energy level is generally set at 1-20% of the total amount of radiation energy, preferably 1-10%, and more preferably 1-5%. By varying radiation wavelengths, preferable molecular weight distribution after hardening results, obtaining significant effects with extremely low viscosity composition such as ink-jet ink. On the other hand, in cases when high illumination is radiated only once, the rate of polymerization is enhanced, however, the molecular weight of the polymerized polymer is small, resulting in not having enough strength.

Further, in cases when the Initial radiation is performed at a longer wavelength than the following radiation, the surface layer of ink is hardened enough to restrain ink bleeding by the initial radiation, and ink adjacent to the printed recording medium where radiation rays barely reach, is hardened to improve adhesiveness by the following radiation. To accelerate hardening of the ink inside, the wavelength of the second radiation rays is preferably longer wavelength.

The ink-jet image forming method of this invention is to use the above mentioned ink and to emit radiation rays 0.01-0.5 second after ink deposition, preferably 0.01-0.3 sec., and more preferably 0.01-0.15 sec., in conjunction with heating of ink to the specific temperature. Controlling the time period from ink deposition to radiation to be an extremely short period as described above, it becomes possible to prevent bleeding of deposited ink before it is hardened.

In this invention, one of the characteristics is that the integrated illuminance in wavelengths at 200-400 nm on the recording medium surface is 0.5-80 mW/cm$^2$ employing the foregoing ultraviolet radiation means.

When the integrated illuminance is above 80 mW/cm$^2$, electric power consumption increases. In addition to that, when the media to be recorded is made of thermally unstable materials, the media may be shrunk due to heat. In order to avoid the influence of heat, sufficient heat releasing or light shielding systems are required, which results in increased cost.

When the integrated illuminance is below 0.5 mW/cm$^2$, hardening of ink tends to be insufficient, which may cause sticking the printed materials with each other or the ink may taint other object due to insufficient drying.

As an applicable ultraviolet radiation means, the light source preferably has a peak wavelength at 290-370 nm, and specifically preferably 290-320 nm. In this invention, the integrated illuminance in wavelengths of 290-370 nm is most preferably 0.5-10 mW/cm$^2$.

In the present invention, the spectral illumination mentioned above is measured by using spectrophotometer USR-40D/V manufactured by Ushio Inc. with 10 nm measuring pitches.

In the ink-jet image forming method of this invention, various recording media known in the art may be employed, and preferred is an ink non-absorptive recording medium.

A recording medium exhibiting no ink absorbability (a non ink absorptive recording material) refers to a recording medium comprised of a material exhibiting no ink absorbability, or comprised of a material having a surface layer (a printing layer) which comprises a non ink absorptive material. As non ink absorptive materials, for example, listed are various kinds of plastic films, metals and various types of glass described below.

As the recording media used in this invention, typical examples are paper the surface of which is coated with a resin, a metal, glass, and various kinds of non ink absorptive plastic films, generally used for flexible packaging materials. As materials for flexible packaging, preferred are polyester, polyolefin, polyamide, polyester amide, polyether, polyimide, polyamide imide, polystyrene, polycarbonate, poly-p-phenylenesulfide, polyether ester, polyvinyl chloride, poly (metha)acrylate ester, polyethylene, polypropylene, and nylon. Further, copolymers or blended materials and even cross-linked materials of these can be employed. Of these, an oriented polyethylene terephthalate, polystyrene, polypropylene, and nylon are preferable from the viewpoint of transparency, dimensional stability, stiffness, environmental burden, and cost. The thickness of the film is preferably 2-100 μm, more preferably 6-80 μm, and still more preferably 10-70 μm.

In the present invention, from the viewpoint of cost of the recording material such as the cost of the package or production cost, and the production efficiency of the printing, and also on the viewpoint at which it can cope with printing of each of varying sizes of media, it is advantageous that a long roll type recording material is used.

EXAMPLES

The present invention will be further described below based on examples, but the embodiments of the present invention are by no means limited by these examples.

Example 1

Preparation of Ink

Preparation of Cyan Ink

Preparation of Cyan Pigment Dispersion

Based on the method described below, a Cyan Pigment Dispersion was prepared. Further, the dispersion conditions were controlled so that the average diameter of cyan pigment particles remained in the range of 0.2-0.3 μm employing a common dispersion apparatus known in the art, optimally adjusting the dispersion conditions, after which the dispersion was filtered under heated conditions to prepare a Cyan Pigment Dispersion.

C.I. Pigment Blue 15: 3 15 weight parts

A high molecular dispersion agent (Solsperse Series, produced by Zeneca Ltd.) 2 weight parts ARONOXETANE OXT-221 (produced by TOAGOSEI CO., LTD.) 83 weight parts Preparation of Cyan Ink Using Cyan Pigment Dispersion prepared above, Cyan Ink was prepared based on the method described below.

Cyan Pigment Dispersion 17 weight parts

ARONOXETANE OXT-221 (produced by TOAGOSEI CO., LTD.) 48 weight parts

CELLOXIDE 2021P (produced by ASAHI DENKA CO., LTD.) 30 weight parts

SP-152 (photoacid generator) 5 weight parts

The cyan ink prepared above was filtered with a membrane filter at an absolute filtration accuracy of 0.8 μm, after which it was dehydrated by a reduced pressure treatment while heated at 50° C. to obtain the cyan ink.

The viscosity and surface tension at 25° C. of the cyan ink prepared above were each 25.4 mPa·s and 34.8 mN/m.

Ink-Jet Image Recording

At a room environment of 25° C. and 80% RH, cyan images were printed onto the recording media described in Table 1, employing an ink-jet printer comprised of the compositions described in FIG. 1, which had a piezo type ink-jet head (with a nozzle pitch of 360 dpi). An ink supply system was comprised of an ink source tank, a charging line, an ink supply tank immediately anterior to an ink-jet head, a filter, and a piezo type ink-jet head. The portion from the ink supply tank to the ink-jet head section, and also a media transporting section, were each insulated and heated. Temperature sensors were each applied to the ink supply tank, in the vicinity of nozzles of the ink-jet head, and the media transporting section to control temperatures. Ink droplet size was determined to be 7 pl by the piezo type ink-jet head, and solid images were ejected with single size dots and resolving power of 720×720 dpi. Further, when the ink was ejected, the ink was heated to 50° C. at each ink nozzle, and ink viscosity was controlled to 8.2 mPa·s. As a recording medium, employed were 50 μm thick OPP oriented polypropylene) film provided by a corona discharge treatment, and 50 μm thick PET (polyethylene terephthalate) film provided by a corona discharge treatment. Meanwhile, dpi in this invention represents a dot number per inch or 2.54 cm.

After the ink ejected onto each recording medium, in the cases of Samples 1 and 2, the surface temperature of the recording medium was controlled to 40° C. using a heating plate provided to the intermediate portion between the printing section and the ultraviolet radiation section, contacting with the rear side of the recording medium. In the cases of Samples 3 and 4, the heating means was not applied, and the temperature remained at room temperature (25° C.).

Subsequently, ultraviolet radiation was emitted using radiation sources described in Table 1 for the time periods described in Table 1, to obtain Image Samples 1-4.

The evaluation results for Image Samples 5-7 were also shown in Table 1, the irradiation conditions of each sample are also shown in Table 1.

The following light sources were employed as the radiation sources.

1: Black Light (radiation illumination at a peak wavelength of 10 mW/cm$^2$, manufactured by HARISON TOSHIBA LIGHTING Corp.)

2: Sterilization Lamp (radiation illumination at a peak wavelength of 6 mW/cm$^2$, manufactured by HARISON TOSHIBA LIGHTING Corp.)

3: Metal Halide Lamp (radiation illumination at a peak wavelength of 500 mW/cm$^2$, manufactured by JAPAN STORAGE BATTERY CO., LTD.)

Evaluation of Formed Images

Evaluation of Scratch Resistance

Each of the Image Samples (solid cyan image) formed above was measured to determine scratch resistance employing Scratch Tester HEIDON-18 (manufactured by Shinto Scientific Co., Ltd.) with a sapphire stylus measuring needle of 0.8 mmR under an atmosphere of 25° C. and 80% RH. The measurement was performed 3 times for a scratch test of 10 cm under a uniform load. Defined as scratch resistance was the critical load which did result in scratch damage to the recording medium. Based on this measurement value, Scratch Resistance was evaluated according to the following criteria:

A: Scratch Resistance was 200 g or more
B: Scratch Resistance was between 100 g-200 g
C: Scratch Resistance was under 100 g Evaluation of Bending Resistance Bending resistance of the cyan solid images formed above was evaluated under the atmospheric conditions of 25° C. and 80% RH, based on the following criteria:

A: When the solid image printed sample was bent repeatedly, the printed images remained tightly adhered and even cracking was not observed.

B: When the solid image printed sample was bent repeatedly, the printed images remained tightly adhered, but a few cracks were observed.

C: When the solid image printed sample was bent, cracks were observed in the image printed area, and when bending was repeated, peeling occurred.

The obtained results are shown in Table 1.

As is apparent from Table 1, it was proved that the images formed under high humidity conditions employing the ink-jet image forming method comprising constitutions of the present invention were superior in scratch resistance and bending resistance compared to the comparative examples.

Image Samples 8 and 9 were prepared in order to demonstrate their hardening property by changing the irradiation condition. Table 1B shows that the sample of the present invention gives an expected effect.

The hardening property was evaluated according to the following criteria:

TABLE 1

| | Recording Medium | | | Radiation Light Source | | | | Evaluation Result | | |
|---|---|---|---|---|---|---|---|---|---|---|
| Image Sample No. | Kind | Thickness (μm) | Heating Temperature (° C.) | Kind | Peak Wavelength (nm) | Integrated Illuminance (mW/cm$^2$) | Radiation Time (sec) | Scratch Resistance | Bending Resistance | Remarks |
| 1 | OPP | 50 | 40 | Black Light | 365 | 10 | 0.5 | A | A | Inv. |
| 2 | PET | 50 | 40 | Sterilizing Lamp | 365 | 6 | 0.5 | A | A | Inv. |
| 3 | OPP | 50 | None (25) | Black Light | 365 | 10 | 3.0 | B | C | Comp. |
| 4 | PET | 50 | None (25) | Metal Halide Lamp | 365 | 500 | 0.5 | A | C | Comp. |
| 5 | PET | 50 | 40 | Metal Halide Lamp | 365 | 100 | 0.1 | A | C | Comp. |
| 6 | PET | 50 | 40 | Metal Halide Lamp | 365 | 70 | 0.07 | A | B | Inv. |
| 7 | PET | 50 | 40 | Sterilizing Lamp | 365 | 48 | 4.0 | A | A | Inv. |

Inv.: This Invention
Comp.: Comparative Example

A: No sticky to a finger
B: Slightly sticky to a finger, but the ink does not taint a finger
C: Sticky to a finger and the ink taints a finger

TABLE 1B

| | Recording Medium | | | Radiation Light Source | | | | | |
|---|---|---|---|---|---|---|---|---|---|
| Image Sample No. | Kind | Thickness (μm) | Heating Temperature (° C.) | Kind | Peak Wavelength (nm) | Integrated Illuminance (mW/cm$^2$) | Radiation Time (sec) | Evaluation Result Hardning property | Remarks |
| 8 | OPP | 50 | 40 | Black Light | 365 | 10 | 3.0 | A | Inv. |
| 9 | OPP | 50 | 40 | Black Light | 365 | 0.4 | 0.012 | C | Comp. |

Inv.: This Invention
Comp.: Comparative Example

Example 2

Yellow, magenta and black ink were prepared in the same manner as the Cyan ink of Example 1, except that the coloring material of C.I. Pigment Blue 15: 3 was respectively changed to C.I. Pigment Yellow 13, C.I. Pigment Red 57: 1, and C.I. Pigment Black 7. Ink-jet image recording and evaluation of the formed images were performed in the same manner as Example 1, with the same results as Example 1, in examples using yellow ink, magenta ink and black ink, the images formed under the high humidity conditions employing the ink-jet image forming method comprising constitutions of the present invention were superior in scratch resistance and bending resistance compared to the comparative examples.

According to the present invention, it is possible to provide an ink-jet printer having a means to heat an ultraviolet curing type ink deposited onto a recording medium and an ultraviolet radiation means which enhances scratch resistance and bending resistance of images printed under atmospheric conditions of high humidity, and an ink-jet image forming method using the same.

What is claimed is:

1. An ink-jet printer for applying a photocurable ink, comprising:

an ink-jet head having a plurality of nozzles to jet droplets of the photocurable ink onto a recording material;

a ultraviolet ray radiation source; and a heating device for heating the recording material to a temperature of 35 to 55° C., said heating device positioned between the inkjet head and the ultraviolet source, said heating device heating the recording material after the ink is deposited on the recording material and before the ink is fixed by radiation from the radiation source so as to maintain a temperature of the ink on the recording material in a predetermined range, wherein the radiation source produces an integrated illuminance of 0.5 to 80 $mW/cm^2$ on the recording material in the range of 200 to 400 nm.

2. The ink-jet printer of claim 1, wherein an irradiation time by the ultraviolet ray radiation source is not more than 1.0 second.

3. The ink-jet printer of claim 1, wherein the photocurable ink contains a photopolymerizable cationic monomer.

4. The ink-jet printer of claim 1, wherein the recording material is non ink absorptive.

* * * * *